US005697198A

United States Patent [19]

Ponder et al.

[11] Patent Number: 5,697,198

[45] Date of Patent: Dec. 16, 1997

[54] USE OF NETTING MATERIAL TO SUPPORT CELLULOSE INSULATION IN FRAMED WALLS DURING CONSTRUCTION

[75] Inventors: Dave Ponder, Salem, Ind.; Dean Birch, Mecosta, Mich.

[73] Assignee: Regal Industries Inc., Crothersville, Ind.

[21] Appl. No.: 423,463

[22] Filed: Apr. 19, 1995

[51] Int. Cl.[6] ..... E04B 1/74

[52] U.S. Cl. ..... 52/742.13; 52/746.1; 52/404.1

[58] Field of Search ..... 52/742.1, 742.13, 52/742.14, 745.09, 745.21, 404.1, 407.3, 407.4, 309.1; 156/71

[56] References Cited

U.S. PATENT DOCUMENTS

| | | | |
|---|---|---|---|
| 1,530,662 | 3/1925 | Gibbons et al. | 52/742.1 |
| 2,989,790 | 6/1961 | Brown . | |
| 4,021,972 | 5/1977 | Choate et al. . | |
| 4,125,982 | 11/1978 | Ward | 52/742.13 X |
| 4,134,242 | 1/1979 | Musz et al. | 52/309.1 |
| 4,292,777 | 10/1981 | Story . | |
| 4,385,477 | 5/1983 | Walls et al. | 52/742.13 |
| 4,397,122 | 8/1983 | Cros | 52/404.1 X |
| 4,487,365 | 12/1984 | Sperber . | |
| 4,635,423 | 1/1987 | Ward | 52/742.1 X |
| 4,712,347 | 12/1987 | Sperber | 52/404.1 |
| 4,829,738 | 5/1989 | Moss | 52/742.13 |
| 5,287,674 | 2/1994 | Sperber | 52/742.13 |
| 5,324,391 | 6/1994 | Carney et al. . | |
| 5,365,716 | 11/1994 | Munson | 52/742.13 |
| 5,379,568 | 1/1995 | Murray | 52/742.1 |

FOREIGN PATENT DOCUMENTS

| | | | |
|---|---|---|---|
| 2070101 | 12/1993 | Canada | 52/404.1 |
| 2139665 | 11/1984 | United Kingdom | 52/404.1 |

*Primary Examiner*—Carl D. Friedman
*Assistant Examiner*—Laura Saladino
*Attorney, Agent, or Firm*—Woodard, Emhardt, Naughton Moriarty & McNett

[57] ABSTRACT

A method of supporting loose fill insulation in a wall cavity with a flexible netting. The netting is secured to the wall cavity frame by fastening the upper and lower edges of the netting to the upper and lower wall joists with a multiplicity of spaced apart fasteners, and gluing the two side edges of the netting to the left and right vertical studs with a flowable adhesive. A small slit is made in the netting to accommodate the insulation nozzle, which is preferably angled at its end to facilitate reaching into small spaces and cracks. Loose fill insulation is blown into the cavity behind the netting after inserting the insulation hose through the slit in the netting.

12 Claims, 4 Drawing Sheets

USE OF NETTING MATERIAL TO SUPPORT CELLULOSE INSULATION IN FRAMED WALLS DURING CONSTRUCTION

FIELD OF THE INVENTION

The present invention relates generally to methods for providing loose fill insulation in the walls of a building, and more particularly to a method of using netting to support loose fill cellulose insulation in the wall of a building.

BACKGROUND OF THE INVENTION

Loose fill cellulose insulation is known to be a superior insulating material from both a cost and efficiency standpoint. While other insulating materials such as fiberglass batts, etc., may alternatively be used, the low cost and high efficiency properties of loose fill cellulose make it ideal for many insulating needs, particularly for new home construction.

As is commonly known, building walls typically include both an inner wall material and an outer wall material, with the two pieces being spaced apart by being installed over a frame of studs and wall joists. When loose fill cellulose insulation is used, it is preferably installed in the space between the inner and outer wall pieces by blowing the insulation into the wall cavity as the wall is being constructed. This avoids having to make holes in the wall surfaces or having to remove and replace portions of the wall.

Most commonly, the cellulose insulation is blown into the space which will be between the outer wall material and the inner wall material before the inner wall material is installed. Thus, when the insulation is blown in, the wall cavity is defined by the outer wall material and the four sides of the wall frame, normally the upper and lower wall joists and the vertical studs. Because this space is open to the front where the inner wall material will go, it is necessary to provide some support for the insulation material until the inner wall is installed.

The use of netting material to hold loose fill cellulose insulation in place before the inner wall is installed is known. For example, U.S. Pat. No. 4,712,347 to Sperber relates to a method of installing loose fill or particulate insulation between the outer and inner walls of a building wherein netting material is used to support the insulation before the inner wall is installed. Similarly, U.S. Pat. No. 5,287,674 to Sperber relates to a method of installing loose fill insulation in building walls wherein a netting material is used in combination with a polypropylene filter material to support the insulation before the inner wall is installed.

The Sperber patents do not address the problem of "bowing" or "bulging" of the insulation material out of the wall cavity. This is due, perhaps, to the type and/or amount of insulation used by Sparbar, likely loose fill or particulate fiberglass which is commonly used at a density of about one pound per cubic foot. In particular, Sperber states that bowing of about 0.5 to 1.0 inches is desired as an indicator that the appropriate insulation density has been reached; the bowing further being taught as not interfering with the installation of the inner wall onto the studs. See, e.g., U.S. Pat. No. 4,712,347 at col. 4, lines 45–51.

With loose fill cellulose however, bowing or bulging of the insulation material can be a significant problem indeed. It has been found that bulging of 0.5 inches can cause problems during installation of the drywall, due to the greater density at which loose fill cellulose is used. In particular, whereas the loose fill fiberglass used by Sperber is used at a density of about one pound per cubic foot, loose fill cellulose is used at a density of at least about three pounds per cubic foot. Thus, the prior art method of Sperber, (commercially called the "Blow-In-Blanket" or "BIB" system) does not address the fact that loose fill cellulose bulges at recommended insulation densities making it difficult to install the inner drywall or paneling flush over the insulated space.

A need therefore exists for a method of installing loose fill cellulose insulation that prevents bulging of the installed insulation material. The present invention addresses that need.

SUMMARY OF THE INVENTION

Briefly describing one aspect of the present invention, there is provided a method of using flexible netting to hold loose fill insulation in position in a wall cavity until the inner wall material can be installed. The inventive method combines the speed associated with methods that rely strictly on staples to hold the netting, with the superior support which adhesives provide.

The netting is initially secured to the wall cavity frame by fastening the upper and lower edges of the netting to the upper and lower wall joists with a multiplicity of spaced apart fasteners. Then, the netting is glued to each of the vertical studs with a flowable adhesive so that each of the horizontal strands of netting material is secured to each vertical stud. If desired, the side edges may be stapled to the vertical studs before they are glued to initially support and hold the netting material in place.

To blow in the insulation, a small slit is made in the netting to accommodate an insulation hose nozzle, which is preferably angled at its end to facilitate reaching into small spaces and cracks. Loose fill insulation is blown into the cavity behind the netting after inserting the insulation hose through the slit in the netting. The inner wall surface can then be installed without removing the netting material.

One object of the present invention is to provide a method of supporting loose fill insulation in a wall cavity before the interior drywall or paneling is installed.

A further object of the present invention is to provide an inexpensive method of insulating all cavities of a house with cellulose and foam during construction without interfering with any of the established construction sequence of events and practices.

Further objects and advantages of the present invention will be apparent from the following description.

DESCRIPTION OF THE PREFERRED EMBODIMENT

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As previously indicated, the present invention uses a flowable adhesive to secure each of the horizontal strands of netting material to each of the vertical studs, thus providing the support necessary to avoid bowing or bulging of the insulation material. The upper and lower edges of the netting are stapled or nailed to the upper and lower wall joists to hold the netting in place in those locations where bulging is not a problem and speed of installation is desired. In the preferred embodiments the side edges of the netting are first stapled to the vertical studs to initially support and hold the netting material in place while the adhesive is applied.

Figure 1:
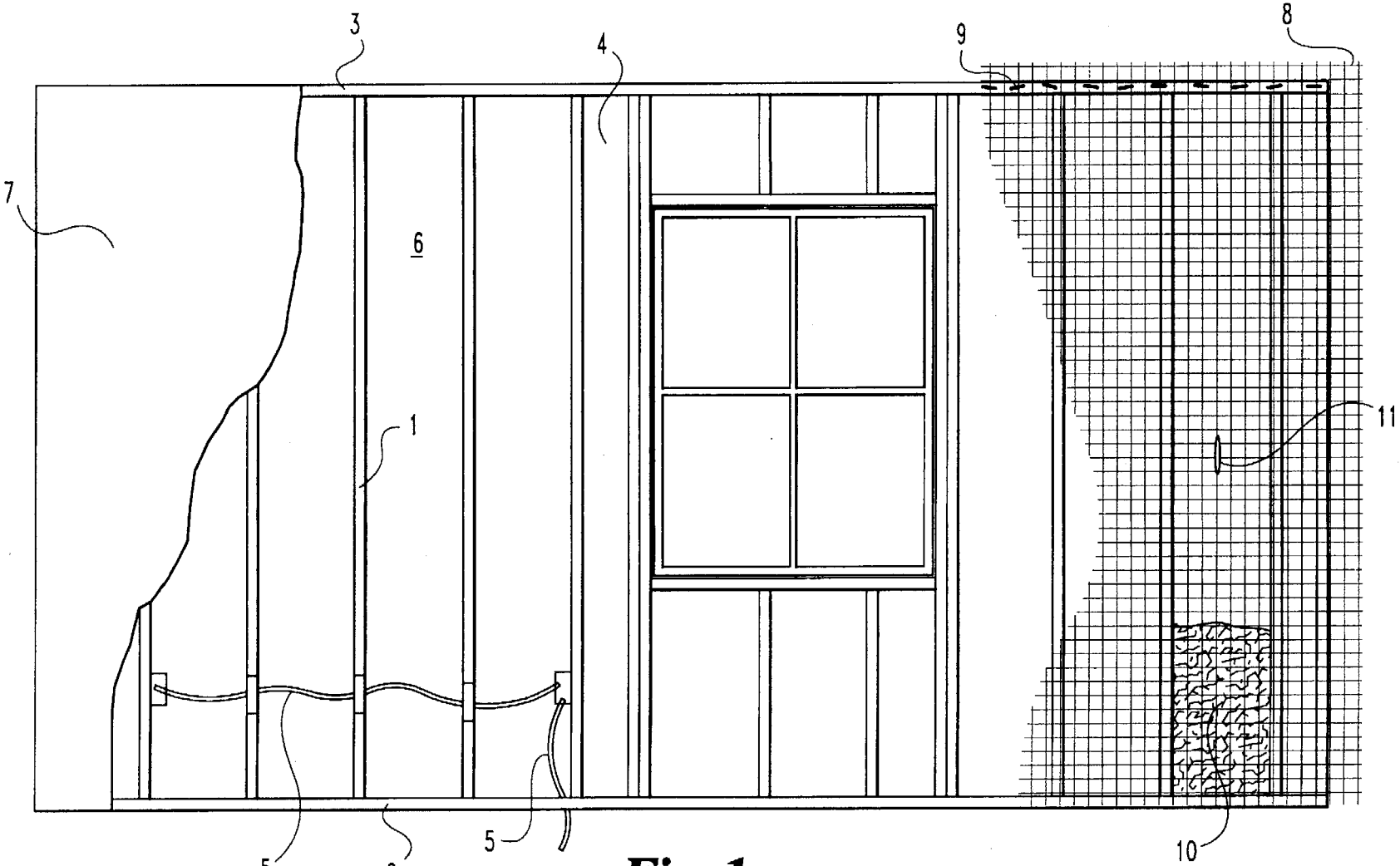
FIG. 1 is an elevational view of a wall which is partially insulated with loose fill cellulose insulation according to one preferred embodiment of the present invention.

Referring to the Figures, FIG. 1 shows the support skeleton for the inner walls of a building structure. The structure includes a number of vertically extending studs 1 mounted between lower joists 2 and upper joists 3. The studs 1 are typically spaced uniformly from one another except where apertures or corners interrupt the even spacing. When this happens, small cavities 4 are created. Accordingly, a number of wall spaces opening toward the interior are formed between each adjoining pair of vertical studs.

After the outer wall material 6 has been installed, it is desirable to place insulation in the wall spaces before the inner wall material 7 is installed. With this method, there is no need to remove part of the inner wall to gain access to the wall spaces.

To support the insulation before the inner wall is installed however, a support material must be placed where the inner wall will be. The support material must keep the insulation material completely back in the wall cavity so that the inner wall may be installed flush against the studs. Even a ½ inch bowing of the netting material may mean that the drywall cannot be installed properly.

It is also preferable to allow air to escape from the cavity as the insulation material is being blown in. This also helps to keep the insulation material from extending outward from the wall cavity.

To accomplish these goals, netting material 8, preferably ⅛ inch opening polypropylene with a per strand rating of at least one pound, is secured to the inwardly facing sides of the studs and joists in the following manner. The netting is commonly ⅛ mesh×8 ft. tall, and comprises a plurality of vertical strands and a plurality of horizontal strands when the netting is installed over the wall frame.

First, the netting is unrolled on the floor in front of the wall to be covered. The netting is then cut to fit the wall to be insulated with some overhang provided. Preferably, the netting is cut approximately one foot longer than the wall to allow for errors in cutting, etc.

In one preferred embodiment, netting 8 is first stapled in the upper right corner to the top plate (joist) 3 using standard construction staples 9. It is preferred to allow approximately 4 inches excess past the corner so that excess netting is provided on each end to provide a handhold for stretching and to compensate for cutting errors. The netting is stapled across the top plate 3 every two to six inches stretching the net on the go. The top of the netting is kept in alignment with top plate 3.

Once the netting is stapled to top plate 3, it is stretched taunt in the middle towards the bottom plate 2 and stapled there. Then the netting is stapled to the bottom plate 2 every 2 to 6 inches, stretching on the go and working from the middle out to the corners.

After the upper and lower edges have been stapled to the upper and lower joists, it is preferred to also staple the netting to at least some of the vertical studs to initially hold the netting in place. Most preferably, the corner vertical studs are stapled every 4 to 12 inches stretching from the middle upward and downward.

The foregoing method is used on every wall to be insulated, covering the whole wall. Once the netting is in place it is easily cut to uncover any aperture areas required such as windows, doors, electrical boxes, plumbing, etc.

After netting 9 has been stapled to joists 2 and 3, and to some of studs 1, the netting is glued to the face of the vertical studs 1 for the whole length of the stud. The adhesive finally applied should be substantially smooth and flat relative to the stud face. This can be accomplished by applying a small continuous bead 20 of adhesive with a common caulking gun. Then the adhesive is smoothed with a putty knife or similar instrument. The caulking gun can have a smoothing device mounted directly to it to eliminate the extra smoothing step. PL 200 construction adhesive manufactured by CHEMREX Inc., Contech Brand, Minneapolis, Minn., works well. Preferably a construction adhesive which drys quickly and is not affected by the low ambient temperatures experienced during winter construction is used.

In cases were the wall framing is metal or some other material which does not readily accommodate staples or nails, it is desirable to use a "hot glue" gun to glue the corners and top and bottoms edges of the netting. Then, the vertical studs can be glued with adhesive as described for the most preferred embodiment above.

Cellulose insulation 10 is blown into the cavities formed by the studs and netting in the following manner. First, an aperture 11 is cut (a common knife may be used) into netting 8 near the center of each cavity. In one preferred embodiment the aperture is a vertical slit about six inches long, positioned about 40 inches off the floor. Although the height off the floor will depend in part on operator height and preference, it has been found that placing the aperture about 40 inches off the floor generally works best for an eight foot tall cavity.

The cellulose is propelled to the cavity by any suitable blowing means, preferably an air blower 12 with a hose 13 for directing and placing the insulation. Hose 13 may be virtually any length and diameter consistent with the delivery rate of the cellulose blowing machine being used, but preferably at least the last several feet of the hose 13 is about two inches in diameter. This size hose is easily maneuvered within the cavity.

Figure 2:
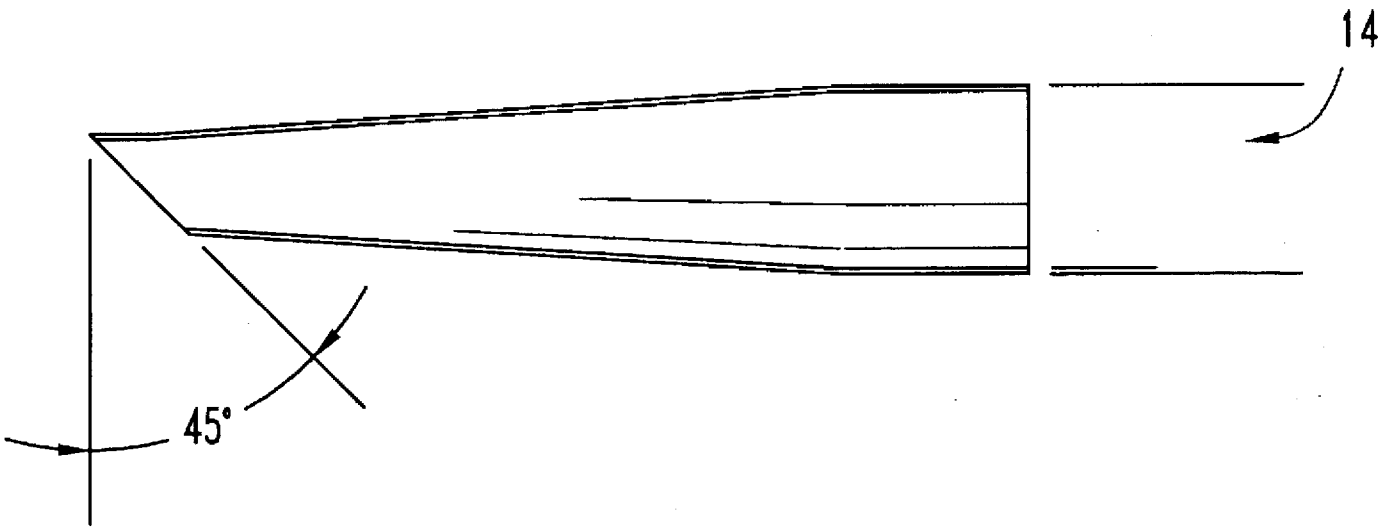
FIG. 2 is a diagram of the insulation hose nozzle end, according to one preferred embodiment.
Figure 3:
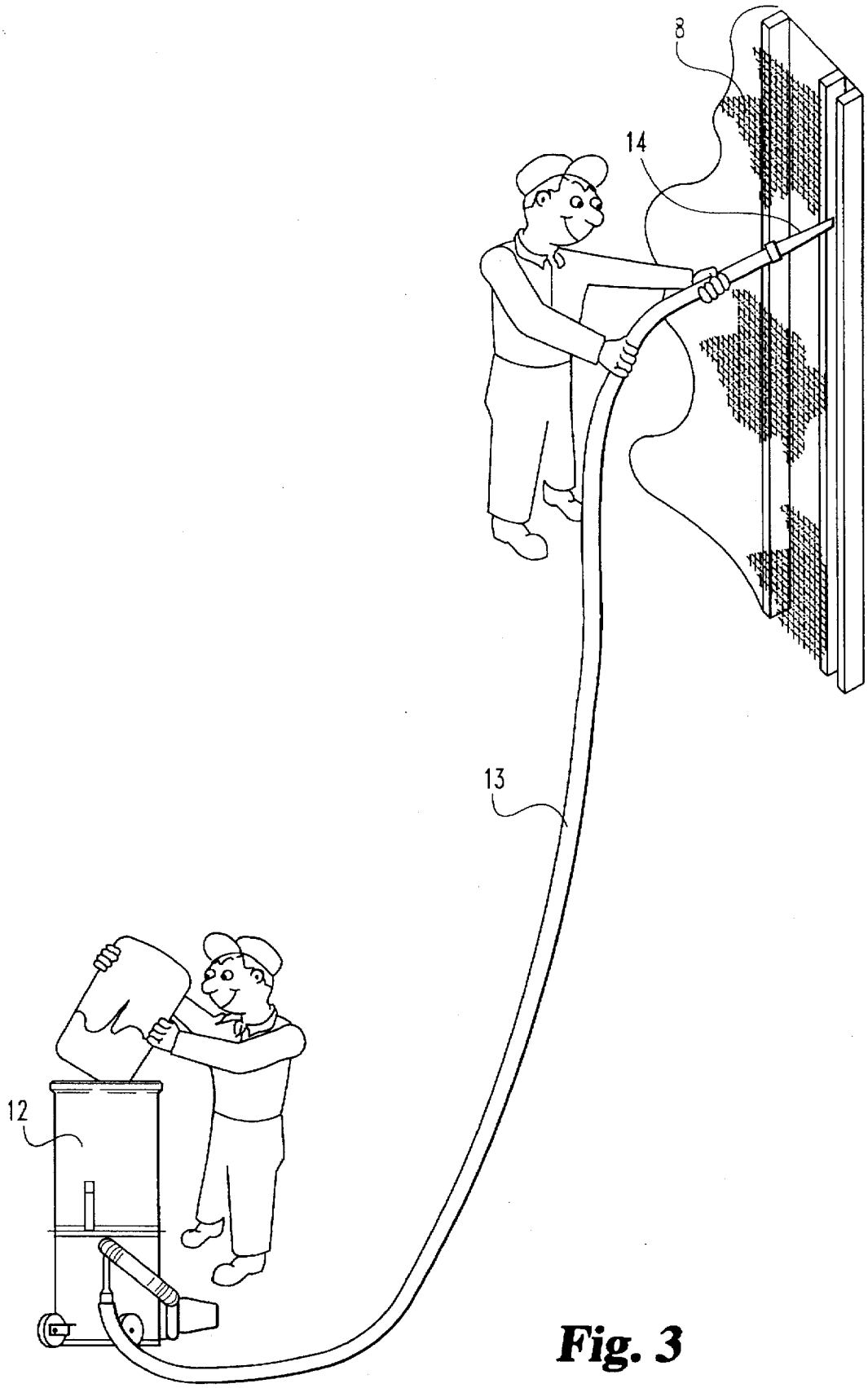
FIG. 3 is a perspective view of a wall being insulated with loose fill cellulose insulation according to one preferred embodiment of the present invention.
Figure 4:
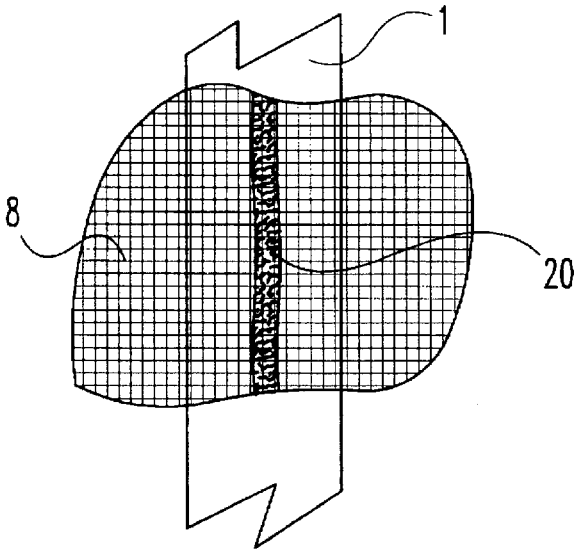
FIG. 4 shows the adhesive material applied as a thin, continuous bead.
Figure 5:
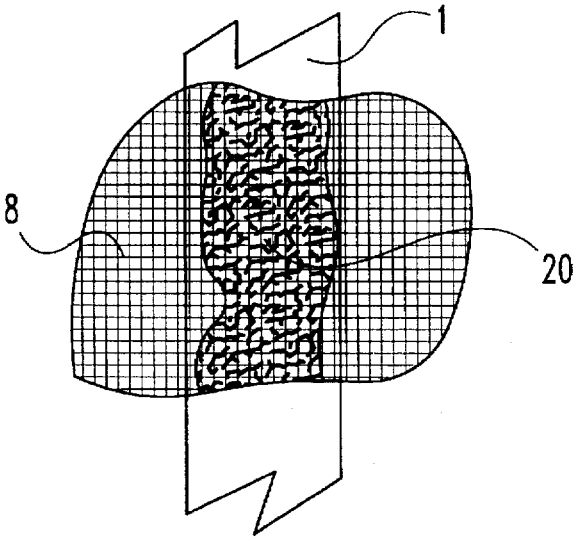
FIG. 5 shows the adhesive material after it has been smoothed and flattened to cover the entire width of a stud.

In one preferred embodiment a unique hose end is used. In particular, as shown in FIG. 2, the end portion of nozzle 14 and hose 13 is trimmed to approximately 45 degrees. This 45 degree trim serves two purposes. First it allows the operator to maneuver around obstructions within the cavity such as electrical wires 5. By wedging the small end of the hose 13 behind the wire 5 and then twisting, the hose 13 can be pushed past the wire 5 to the bottom of the cavity. Secondly, by turning the hose 13 so the angled cut is facing away from the operator, cellulose fills around it thus providing a filter so much of the dust is trapped within the cavity instead of fogging the operator area. When using nozzle 14 on the end of hose 13 to fill small cavities, the 45° trim serves similarly.

The hose is inserted into the cavity through the slit and pushed downward to within a few inches of the bottom plate.

The angled end of the hose is turned away from the operator and the blowing means is started. As the cellulose material is delivered, the hose is withdrawn with a series of small upward jerks as each layer beneath the end of the hose is filled. If during withdrawal, pockets form that are not fully packed (sometimes vertical runs of wire 5 will cause this), the hose can be pushed into those areas to complete the filling.

When the slit position is reached, the hose is turned upward and pushed about six inches above the slit position and paused until enough cellulose has been delivered to effect a filter function. Then the hose is pushed to the top of the cavity and withdrawn in a series of small downward jerks. As described above, any pockets that form are filled by pushing the hose into them.

For cavities that are too small for hose insertion (typically one to three inches in width or height), a one inch nozzle (FIG. 2) is placed on the end of the hose. The nozzle is inserted through the netting in as many positions as needed to fill the cavity.

For cavities that are too small for the one inch diameter nozzle, a foam-in-place insulation material may be used.

It is to be appreciated that the present invention provides a method of supporting the netting that minimizes bulging and therefore keeps the insulation material from extending beyond the vertical stud face. Additionally, the smoothed and flattened adhesive 21 totally excludes cellulose from the faces of the studding. Thus, with this method a denser pack of insulation may be used, improving insulating efficiency while still allowing a flush fit of the interior drywall.

In particular, the present invention secures each of the horizontal strands of netting material to each of the vertical studs. In the previous art, a continuous holding of the netting that adhesive accomplishes was not specified. With no continuous holding of the net on the vertical studs, any push against the netting strands in the cavity being filled is transferred to adjacent cavities until a staple or nail is found on the same strand as the applied force. So with the same force applied, relative cavity to cavity bulges will be different. With adhesive applied according to the present invention, the forces are limited to the width of the cavity being filled. This results in an even fill of the cavity and bulging is minimized allowing easy installation of the drywall.

It is also to be appreciated that the present invention allows construction contractors to reduce their inventory because they do not have to stock multiple widths of fiberglass batts. If the contractor normally uses wet cellulose spray-on insulation instead of fiberglass batts, they must wait until the cellulose dries before installing the drywall. With the method of the present invention, the drywall can be installed immediately after the cavity has been filled.

While the invention has been illustrated and described in detail in the foregoing description, the same is to be considered as illustrative and not restrictive in character, it being understood that only the preferred embodiment has been shown and described and that all changes and modifications that come within the spirit of the invention are desired to be protected.

What is claimed is:

1. A method of installing loose fill insulation in a wall cavity, said wall cavity being defined by a frame consisting of an upper joist, a lower joist, a first vertical stud and a second vertical stud, the method comprising:

(a) providing a sheet of flexible netting sized to cover said wall cavity, said sheet of flexible netting including a first edge, a second edge, a third edge and a fourth edge;

(b) fastening the netting to the frame by:

(i) fastening said first edge to said upper joist with a multiplicity of spaced apart fasteners;

(ii) fastening said second edge to said lower joist;

(iii) fastening said third edge to said first vertical stud with a flowable adhesive; and (iv) fastening said fourth edge to said second vertical stud with a flowable adhesive; so that the netting is fastened to each of said first and second vertical studs along substantially the entire length of the stud;

(c) providing an aperture in said netting to accommodate a nozzle of a hose for blowing loose fill insulation into the wall cavity; and (d) blowing loose fill insulation into said wall cavity.

2. The method of claim 1 wherein said netting material comprises a plurality of vertical strands and a plurality of horizontal strands, and wherein the flowable adhesive is applied to secure substantially all of the horizontal strands to both said first vertical stud and said second vertical stud.

3. The method of claim 1 and further including the step of fastening the side edges of the netting material to the vertical studs with a multiplicity of spaced apart fasteners before the flowable adhesive is applied.

4. The method of claim 1 wherein the loose fill insulation is blown into place through a hose having an end that is bevelled at an angle of approximately 45 degrees.

5. The method of claim 1 wherein said blowing blows loose fill cellulose insulation into the wall cavity.

6. The method of claim 1 wherein said first edge and said second edge are fastened to said upper joist and said lower joist, respectively, only at selected positions.

7. The method of claim 6 wherein said fastening of said second edge begins near the center of the second edge of the netting.

8. The method of claim 1 and further including the step of applying drywall or paneling over said netting after said blowing.

9. The method of claim 1 wherein said fastening steps are accomplished with staples.

10. A method of installing loose fill insulation in a wall cavity, said wall cavity being defined by a frame consisting of an upper joist, a lower joist, a first vertical stud and a second vertical stud, the method comprising:

(a) providing a sheet of flexible netting sized to cover said wall cavity, said sheet of flexible netting including a first edge, a second edge, a third edge and a fourth edge;

(b) fastening the netting to the frame by:

(i) gluing at least portions of said first edge to said upper joist with an adhesive;

(ii) gluing at least portions of said second edge to said lower joist;

(iii) fastening said third edge to said first vertical stud with a flowable adhesive; and (iv) fastening said fourth edge to said second vertical stud with a flowable adhesive; so that the netting is fastened to each of said first and second vertical studs along substantially the entire length of the stud;

(c) providing an aperture in said netting to accommodate a nozzle of a hose for blowing loose fill insulation into the wall cavity; and (d) blowing loose fill insulation into said wall cavity.

11. The method of claim 10 wherein said gluing is with hot glue.

12. A method of installing loose fill insulation in a wall cavity, said wall cavity being defined by a frame consisting of an upper plate, a lower plate, a first vertical stud and a second vertical stud, the method comprising:

(a) providing a sheet of flexible netting sized to cover said wall cavity, said sheet of flexible netting including a first edge, a second edge, a third edge and a fourth edge;

(b) fastening the netting to the frame by:

(i) fastening said first edge to said upper joist;

(ii) fastening said second edge to said lower joist;

(iii) fastening said third edge to said first vertical stud with a flowable adhesive; and (iv) fastening said fourth edge to said second vertical stud with a flowable adhesive;

wherein the netting is fastened to each of said first and second vertical studs along substantially the entire length of the stud to totally exclude cellulose from the face of the stud and allow a flush fit of any interior drywall;

(c) providing an aperture in said netting to accommodate a nozzle of a hose for blowing loose fill insulation into the wall cavity; and (d) blowing loose fill insulation into said wall cavity.

* * * * *